US009323266B2

(12) United States Patent
Ozanoglu et al.

(10) Patent No.: US 9,323,266 B2
(45) Date of Patent: Apr. 26, 2016

(54) METHOD AND SYSTEM FOR GAIN BOOSTING IN LINEAR REGULATORS

(71) Applicant: Dialog Semiconductor GmbH, Kirchheim/Teck-Nabern (DE)

(72) Inventors: Kemal Ozanoglu, Istanbul (TR); Merve Toka, Istanbul (TR); Selcuk Talay, Istanbul (TR); Frank Kronmueller, Neudenau (DE)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 0 days.

(21) Appl. No.: 14/495,211

(22) Filed: Sep. 24, 2014

(65) Prior Publication Data

US 2015/0177760 A1 Jun. 25, 2015

(30) Foreign Application Priority Data

Dec. 19, 2013 (EP) ..... 13198318

(51) Int. Cl.
*G05F 1/59* (2006.01)
*G05F 1/575* (2006.01)

(52) U.S. Cl.
CPC . *G05F 1/59* (2013.01); *G05F 1/575* (2013.01)

(58) Field of Classification Search
CPC ..... G05F 1/575; G05F 1/59
See application file for complete search history.

(56) References Cited

U.S. PATENT DOCUMENTS

| | | | | |
|---|---|---|---|---|
| 5,672,959 | A * | 9/1997 | Der | G05F 3/247 323/273 |
| 6,046,577 | A * | 4/2000 | Rincon-Mora | G05F 1/575 323/279 |
| 6,246,221 | B1 | 6/2001 | Xi | |
| 6,518,737 | B1 | 2/2003 | Stanescu et al. | |
| 7,218,082 | B2 * | 5/2007 | Walter | G05F 1/575 323/273 |
| 2006/0028189 | A1 | 2/2006 | Akita | |
| 2007/0194768 | A1 * | 8/2007 | Bansal | G05F 1/573 323/277 |
| 2012/0169303 | A1 * | 7/2012 | Chen | G05F 1/573 323/265 |

OTHER PUBLICATIONS

European Search Report 13198318.1-1807 Mailed: Jun. 10, 2014, Dialog Semiconductor GmbH.

* cited by examiner

*Primary Examiner* — Jue Zhang
(74) *Attorney, Agent, or Firm* — Saile Ackerman LLC; Stephen B. Ackerman

(57) ABSTRACT

A method and a system for increasing the open loop gain of linear regulators are presented. A linear regulator to derive an output voltage from an input voltage is described. The linear regulator contains an amplifier to derive an amplifier output signal from an amplifier input signal, and a pass device to convert the amplifier output signal into the output voltage. The linear regulator has a positive feedback loop using a positive feedback gain γ, and a negative feedback loop using a negative feedback gain β. In addition, the linear regulator has a combining unit to determine the amplifier input signal from the input voltage, from the positive feedback signal and from the negative feedback voltage. A transfer function of the linear regulator exhibits a first and a second pole at a first frequency wp1 and at a second frequency wp2, respectively.

25 Claims, 11 Drawing Sheets

METHOD AND SYSTEM FOR GAIN BOOSTING IN LINEAR REGULATORS

TECHNICAL FIELD

The present document relates to linear regulators. In particular, the present document relates to a method and a system for increasing the open loop gain of linear regulators.

BACKGROUND

Increasing the open loop gain of an amplifier is a method that may be used to improve the performance of a linear regulator comprising the amplifier. One method for increasing or boosting the open loop gain is the use of cascade stages. However, such methods may introduce drawbacks as they increase the design complexity and as they may lead to stability issues. Hence, there is a great interest at gain boosting methods which do not add hardware overhead.

A further method for boosting the open loop gain is to use a positive feedback. However, using a positive feedback may force the amplifier to an unstable state during operation.

Power management blocks such as linear drop-out regulators (LDO) may also take advantage of amplifiers with gain boosters. The gain boosting in LDOs may improve the power supply rejection ratio (PSR) and load regulation values. However, gain boosting methods which use positive feedback are typically limited to a positive feedback gain $\gamma<\frac{1}{2}$. Keeping the positive feedback gain $\gamma<\frac{1}{2}$ typically ensures stability, however, such values limit the possibilities for gain boosting. In other words, amplifiers in LDOs may incorporate positive feedback for gain boosting but only with a limited gain.

SUMMARY

The present document addresses the technical problem of providing amplifiers with an increased open loop gain. In particular, the present document addresses the technical problem of providing linear regulators with gain boosting and possibly with no hardware overhead. For this purpose, a method for selecting appropriate values for the feedback gain $\gamma$ and for selecting a pole of the feedback structure are described. By doing this, it is possible to achieve unconditionally stable gain boosted amplifiers and regulators with positive feedback. According to an aspect, a linear regulator configured to derive an output voltage from an input voltage is described. In particular, the linear regulator may be or may comprise a low drop-out regulator. The linear regulator comprises an amplifier configured to derive an amplifier output signal (at an output node of the amplifier) from an amplifier input signal (at an input node of the amplifier). The amplifier may comprise a differential amplifier. Furthermore, the linear regulator comprises a pass device configured to convert the amplifier output signal (at the output node of the amplifier, which may correspond to an input node of the pass device) into the output voltage (at an output node of the pass device). The pass device may comprise a metal oxide semiconductor (MOS) transistor, e.g. an N-type MOS transistor.

The linear regulator further comprises a positive feedback loop configured to determine a positive feedback signal from the amplifier output signal, using a positive feedback gain $\gamma$. In particular, the positive feedback loop may be configured to determine the positive feedback signal by multiplying the amplifier output signal with the positive feedback gain $\gamma$.

In addition, the linear regulator comprises a negative feedback loop configured to determine a negative feedback signal from the output voltage, using a negative feedback gain $\beta$. In particular, the negative feedback loop may be configured to determine the negative feedback signal by multiplying the output voltage with the negative feedback gain $\beta$.

Furthermore, the linear regulator comprises a combining unit configured to determine the amplifier input signal from the input voltage, from the positive feedback signal and from the negative feedback voltage. In particular, the combining unit may be configured to determine the amplifier input signal by adding the positive feedback signal to the input voltage and by subtracting the negative feedback voltage from the input voltage.

A transfer function of the linear regulator may exhibit a first and a second pole at a first frequency wp1 and at a second frequency wp2, respectively. In other words, the linear regulator, in particular the amplifier and/or the pass device, may be designed such that the transfer function of the linear regulator exhibits at least two poles. The provision of at least two poles enables the provision of a linear regulator having a high open loop gain, thereby providing e.g. a linear regulator having a low power supply rejection ratio (PSR). At the same time, the provision of at least two poles ensures the stability of the operation of the linear regulator in an extended frequency range. In addition, it should be noted that the increase open loop gain and stability can be provided without the need for additional hardware.

The second frequency wp2 may be greater than the first frequency wp1. In particular, the second frequency wp2 may be greater than the first frequency wp1 by 3, 4, 5 or more orders of magnitude. By increasing the second frequency wp2, the stable frequency range of the linear regulator may be extended.

The first pole may be associated with the output node of the amplifier (wherein the output node of the amplifier carries the amplifier output signal), and the second pole may be associated with the output node of the pass device (wherein the output node of the pass device carries the output voltage). By way of example, the amplifier may exhibit the first pole at the first frequency wp1 and the pass device may exhibit the second pole at the second frequency wp2.

As indicated above, the provision of a linear regulator having at least two poles allows the provision of a stable linear regulator with high open loop gain. In particular, this may be achieved by appropriately designing the positive feedback loop. In particular, this may be achieved by selecting the positive feedback gain $\gamma$ to be 0.8 or greater, 0.9 or greater, 1.0 or greater.

As outlined above, the amplifier may comprise a differential amplifier. The differential amplifier may comprise a differential pair comprising a first (e.g. a negative side) input transistor and a second (e.g. a positive side) input transistor. The first and second input transistors may be arranged in series with a first and a second load diode, respectively. The positive feedback loop may comprise a first mirror transistor forming a current mirror with the first load diode and a second mirror transistor forming a current mirror with the second load diode. The first mirror transistor may be arranged in series with the second input transistor and the second mirror transistor may be arranged in series with the first input transistor. Hence, the positive feedback loop may be implemented using current mirrors which provide an amplified version of the current on one side of the differential amplifier to the respective other side of the differential amplifier. Each of the current mirrors may provide the positive feedback gain $\gamma$, i.e. the current which is provided to the respective other side of the differential amplifier may be amplified or attenuated by the value $\gamma$.

As will be outlined in more detail in the present document, the use of a differential amplifier provides interesting properties regarding the closed loop gain of the linear regulator and regarding the output impedance of the linear regulator.

The input voltage may be applied to a gate of the second (positive side) input transistor. Furthermore, the output voltage may be fed back to a gate of the first (negative side) input transistor to provide the negative feedback loop. Hence, the linear regulator comprising the positive and the negative feedback loop may be provided using a differential amplifier.

According to a further aspect, a method for providing a linear regulator having a high open loop gain is described. The linear regulator is configured to derive an output voltage from an input voltage. The method comprises deriving an amplifier output signal from an amplifier input signal using an amplifier. Furthermore, the method comprises converting the amplifier output signal into the output voltage using a pass device. In addition, the method comprises determining a positive feedback signal from the amplifier output signal, using a positive feedback gain γ, and determining a negative feedback signal from the output voltage, using a negative feedback gain β. The method comprises further determining the amplifier input signal from the input voltage, from the positive feedback signal and from the negative feedback voltage. The amplifier and the pass device may be selected such that a transfer function of the linear regulator exhibits a first and a second pole at a first frequency wp1 and at a second frequency wp2.

It should be noted that the methods and systems including its preferred embodiments as outlined in the present document may be used stand-alone or in combination with the other methods and systems disclosed in this document. In addition, the features outlined in the context of a system are also applicable to a corresponding method. Furthermore, all aspects of the methods and systems outlined in the present document may be arbitrarily combined. In particular, the features of the claims may be combined with one another in an arbitrary manner.

In the present document, the term "couple" or "coupled" refers to elements being in electrical communication with each other, whether directly connected e.g., via wires, or in some other manner.

BRIEF DESCRIPTION OF THE DRAWINGS

The invention is explained below in an exemplary manner with reference to the accompanying drawings, wherein.

DESCRIPTION

As outlined in the introductory section, the present document addresses the technical problem of providing stable amplifiers with an increased open loop gain. In particular, a method is described which allows achieving theoretically infinite open loop gains with a single error amplifier stage. As a result of this, the performance of LDOs may be improved with no hardware overhead. In particular, the PSR and load regulation and other performance metrics associated with the open loop gain of an amplifier may be improved.

The proposed methods allow the available hardware to be used more efficiently. Furthermore, the specifications of the amplifiers may be relaxed. In addition, the stability of LDOs which use positive feedback in the amplifiers may be improved. The proposed method may be used in various different types of LDOs since a positive feedback loop can be part of the amplifier structure in the form of dynamic biasing or similar. Furthermore by boosting the positive feedback of the load to values larger unity, negative output impedance of the linear regulator may be achieved.

Figure 1:
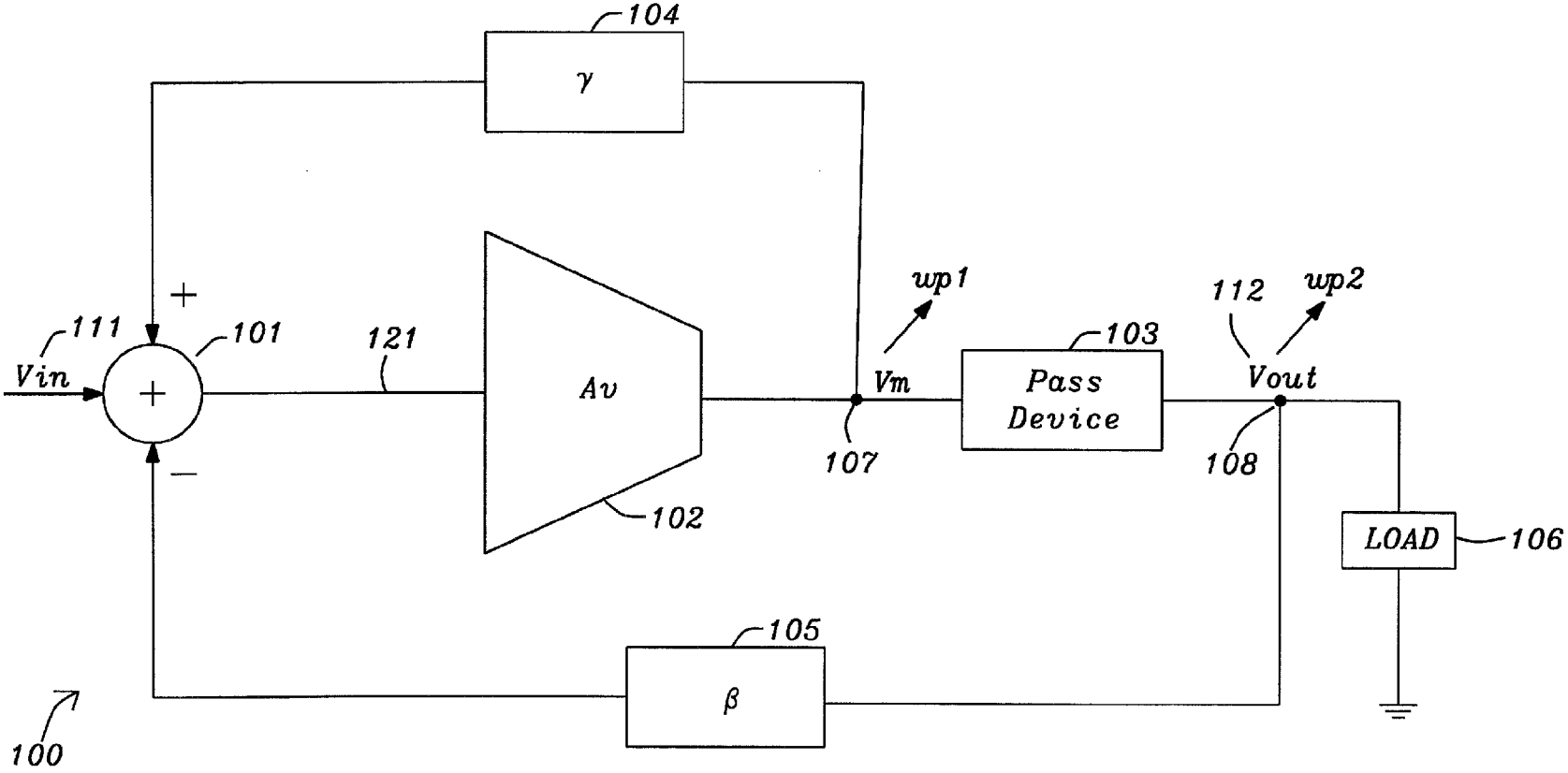
FIG. 1 illustrates a block diagram of an example linear regulator.

FIG. 1 shows a block diagram of an example LDO 100. The LDO 100 comprises one or more amplification stages 102 and a pass device 103. Furthermore, the LDO 100 comprises a positive feedback 104 with a positive feedback gain γ. Furthermore, the LDO 100 comprises a negative feedback 105 with a negative feedback gain β. The positive feedback and the negative feedback are combined with an input voltage 111 of the LDO 100 using the combining unit 101. Hence, the input signal 121 to the one or more amplification stages 102 (referred to in the following as the amplifier 102) is the sum of the input voltage 111 and the positive feedback signal minus the negative feedback signal. The LDO 100 may be configured to derive an output voltage 112 from the input voltage 111 for a load 106 of the linear regulator 100.

In other words, the LDO 100 of FIG. 1 has two feedback loops, a first feedback loop with positive feedback and a second feedback loop with negative feedback. In case of a linear regulator circuit the pass device 103 is positioned between the two feedback loops. The positive feedback with the positive feedback 104 gain γ may be embedded inside the amplifier 102. The value of the positive feedback gain γ and the placement of the poles of the LDO 100 may be selected to provide a stable LDO 100 with a high open loop gain.

The transfer function of the LDO 100 may be written as:

$$\frac{Vout(s)}{Vin(s)} = \frac{Av \cdot Ap}{\left(1 + \frac{s}{wp1} - \gamma \cdot Av\right)\left(1 + \frac{s}{wp2}\right) + \beta \cdot Av \cdot Ap},$$

where Av is the gain of the amplifier 102, where Ap is the gain of the pass device 103, where s the (complex) frequency, where wp1 is a first pole of the transfer function at the output node 107 of the amplifier 102, and where wp2 is a second pole of the transfer function at the output node 108 of the pass device 103. The effect of positive and negative feedback can be seen from the above formula. At DC (i.e. at s=0), the transfer function simplifies to $$\frac{Vout}{Vin} = \frac{Av \cdot Ap}{(1 - \gamma \cdot Av) + \beta \cdot Av \cdot Ap}.$$

In the frequency region where s<<wp2, the term $$\left(1 + \frac{s}{wp2}\right) \approx 1,$$

and the transfer function becomes $$\frac{Vout(s)}{Vin(s)} = \frac{Av \cdot Ap}{\left(1 + \frac{s}{wp1} - \gamma \cdot Av\right) + \beta \cdot Av \cdot Ap}.$$

The above formula is applicable in particular for wp1<wp2, and possibly s>wp1 or s>>wp1.

For the case s>>wp2 and s>>wp1, the transfer function becomes $$\frac{Vout(s)}{Vin(s)} = \frac{Av \cdot Ap}{\frac{s^2}{wp1 \cdot wp2}}.$$

The above formulas may be used to analyze the LDO 100 of FIG. 1. In particular, the open loop gain (with the negative feedback loop being interrupted, i.e. with the negative feedback gain β=0) may be analyzed as a function of frequency s.

In this case, we have for wp1<<wp2:

$$\frac{Vout(s)}{Vin(s)} = \frac{Av \cdot Ap}{(1 - \gamma \cdot Av)} \text{ for } s \ll wp1$$

$$\frac{Vout(s)}{Vin(s)} - \frac{Av \cdot Ap}{\left(\frac{s}{wp1}\right)} \text{ for } wp1 \ll s \ll wp2$$

$$\frac{Vout(s)}{Vin(s)} = \frac{Av \cdot Ap}{\frac{s^2}{wp1 \cdot wp2}} \text{ for } s \gg wp2$$

Figure 2:
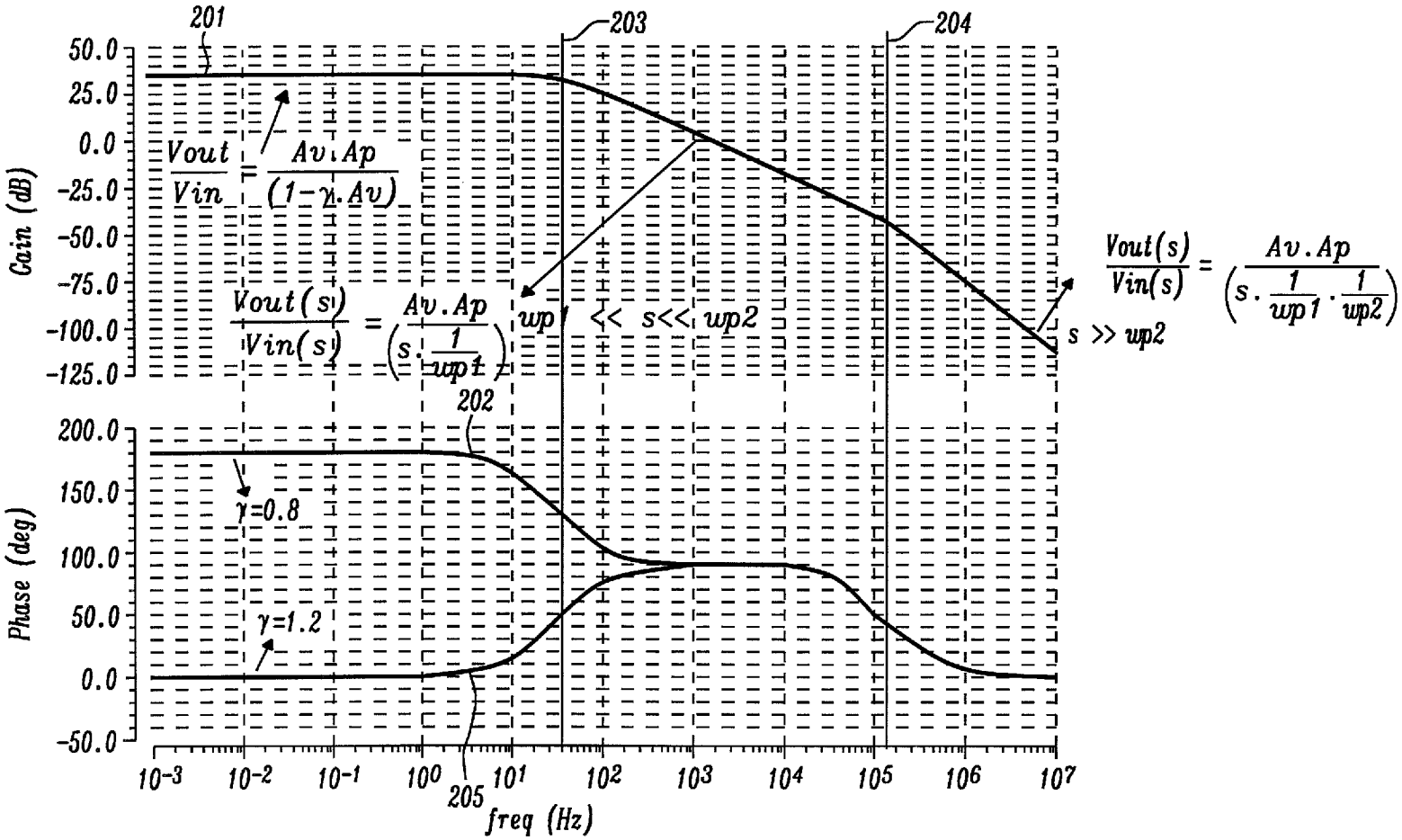
FIGS. 2 to 4 show example open loop gains for the linear regulator of FIG. 1.

FIG. 2 illustrates the magnitude of the open loop gain (reference numeral 201), i.e.

$$\left|\frac{Vout(s)}{Vin(s)}\right|,$$

in dB for different frequencies s and for different values of the positive feedback gain γ, i.e. γ=0.8 and γ=1.2. Furthermore, FIG. 2 illustrates the phase of the open loop gain (reference numeral 202) for different frequencies s and for different values of the positive feedback gain γ, i.e. γ=0.8 (202) and γ=1.2 (205). The two poles wp1 (reference numeral 203) and wp2 (reference numeral 204) can be observed.

Figure 3:
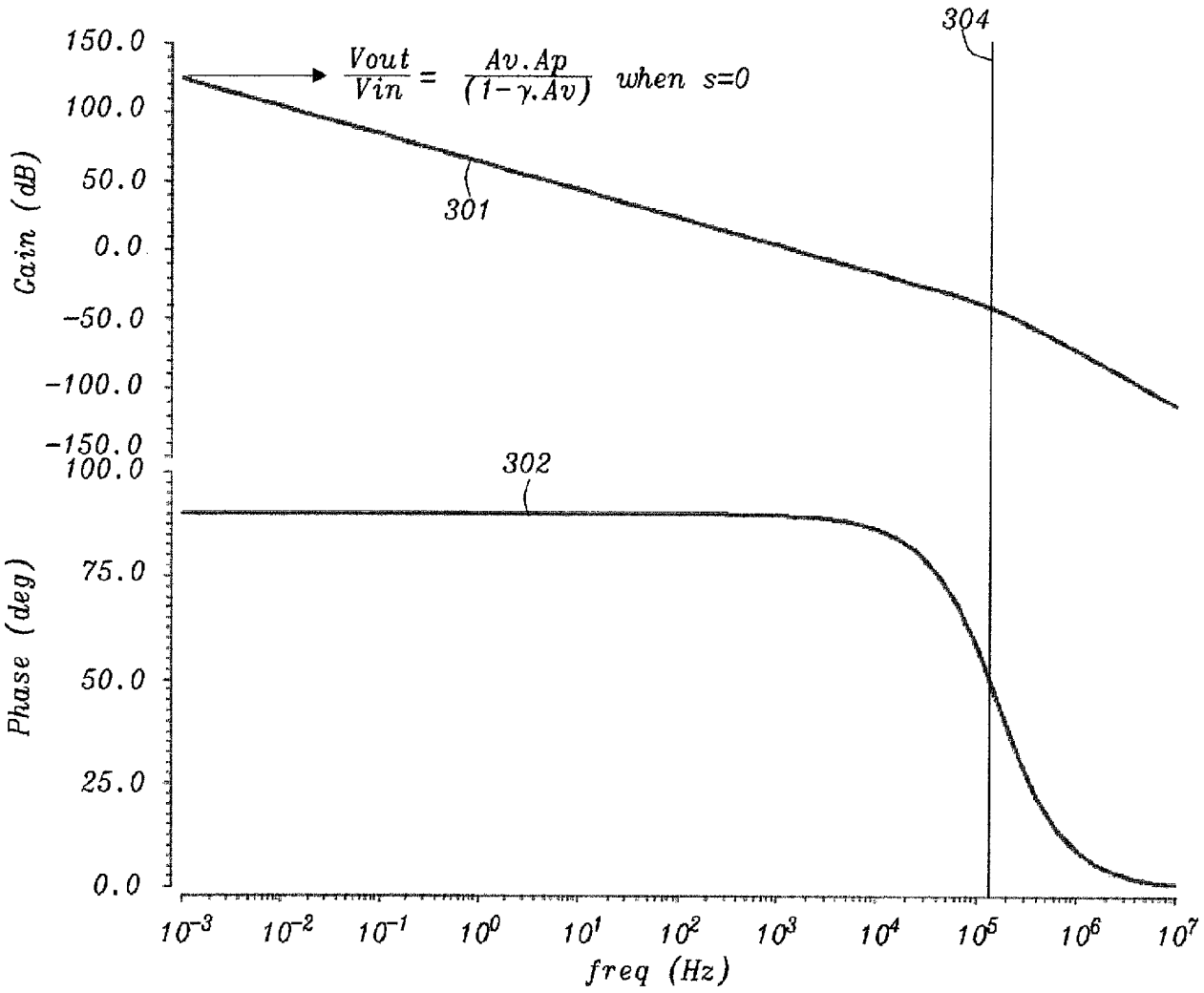

FIG. 3 illustrates the magnitude of the open loop gain (reference numeral 301), i.e.

$$\left|\frac{Vout(s)}{Vin(s)}\right|,$$

in dB for different frequencies s and for a positive feedback gain γ=1. Furthermore, FIG. 3 illustrates the phase of the open loop gain (reference numeral 302) for different frequencies s and for a positive feedback gain γ=1.

Overall, it can be observed that by providing a second pole wp2 which is greater than the first pole wp1, the phase of the open loop gain can be maintained in-phase, i.e. between 0 and 180 degrees, even for a positive feedback gain γ=1 or greater than one. Furthermore, it can be observed that by selecting a positive feedback gain γ=1, substantial values for the magnitude of the open loop gain can be achieved at low frequencies (in particular for s=0). The value of the magnitude of the open loop gain at zero frequency typically impacts the PSR. In particular, a high open loop gain at zero frequency typically leads to a high PSR.

Various techniques may be used to place the first pole wp1 to have a lower frequency value than the second pole wp2. The Miller effect can be used with the gain of the error amplifier 102 as in FIG. 1, to boost an internal capacitor connected to node Vm 107 of the linear regulator 100 shown in FIG. 1. Also the gate parasitic (capacitance) associated with the pass device 103 may be added to the total capacitor at node Vm 107, which will further increase the total capacitor.

Figure 4:
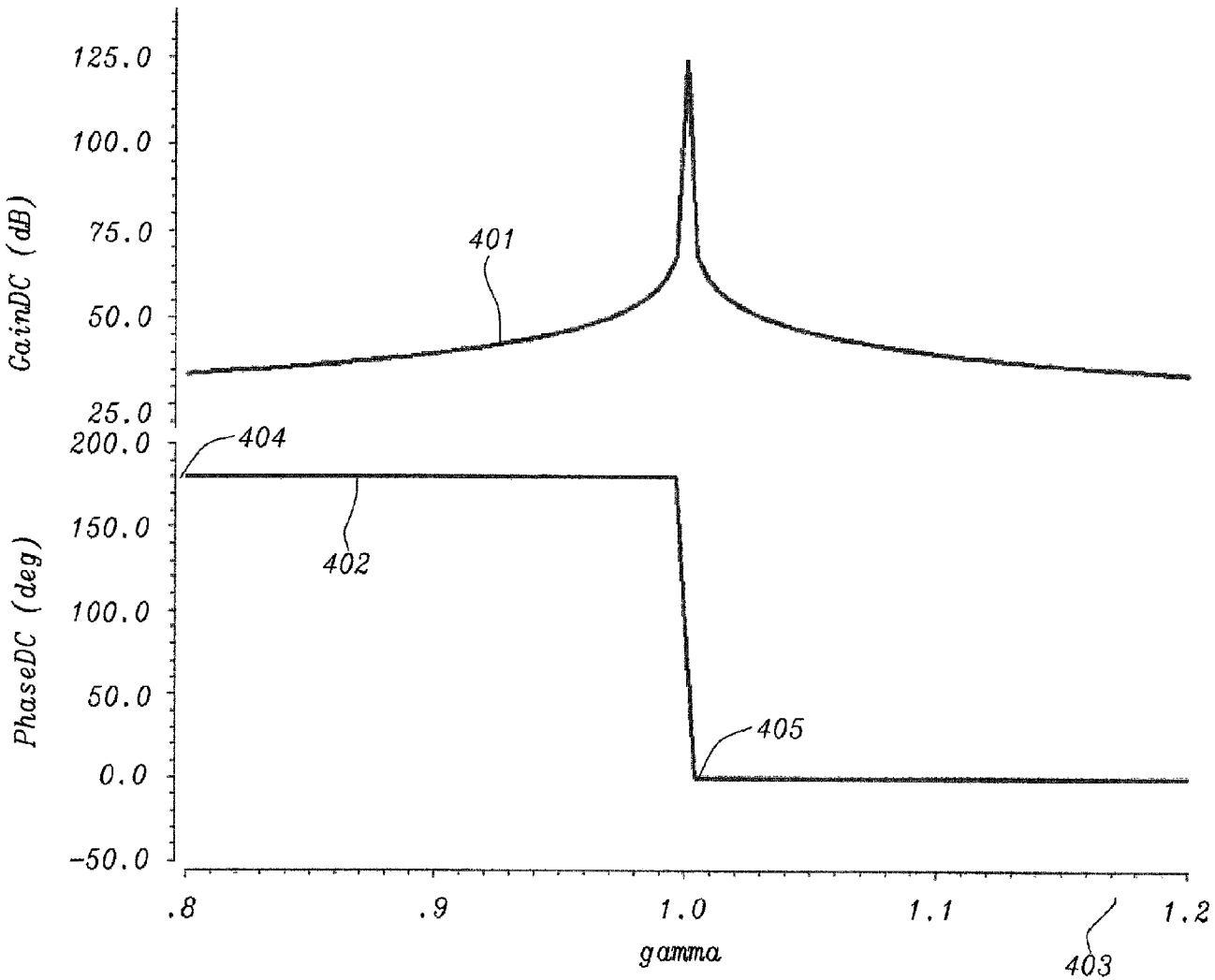

FIG. 4 illustrates the magnitude of the open loop gain 401 and the phase 402 at zero frequency for different positive feedback gains γ 403 ranging from 0.8 to 1.2. It can be seen that the magnitude of the open loop gain 401 peaks at γ=1, thereby allow for high PSRs.

In other words, FIG. 3 depicts the case where γ=1 and FIGS. 2 and 4 show the gain and phase of the linear regulator 100 of FIG. 1 for positive feedback gain values varying from γ=0.8 to γ=1.2. From FIG. 2 two poles 203, 204 can be observed. FIG. 4 provides information regarding the phase changes at low frequencies (s=0) depending on the value of γ. For the low values of γ, a 180 degree phase 404 can be observed. As the value of the positive feedback gain γ is increased above one 405, in-phase operation for low frequencies can be observed. Hence, the proper pole placement allows for the design of a linear regulator 100 of FIG. 1 which is stable and which takes advantage of high open loop gains.

In the following, the output impedance of a closed loop linear regulator 100 of FIG. 1 is analyzed, in particular for the case where the positive feedback gain is γ≥1.

Figure 5:
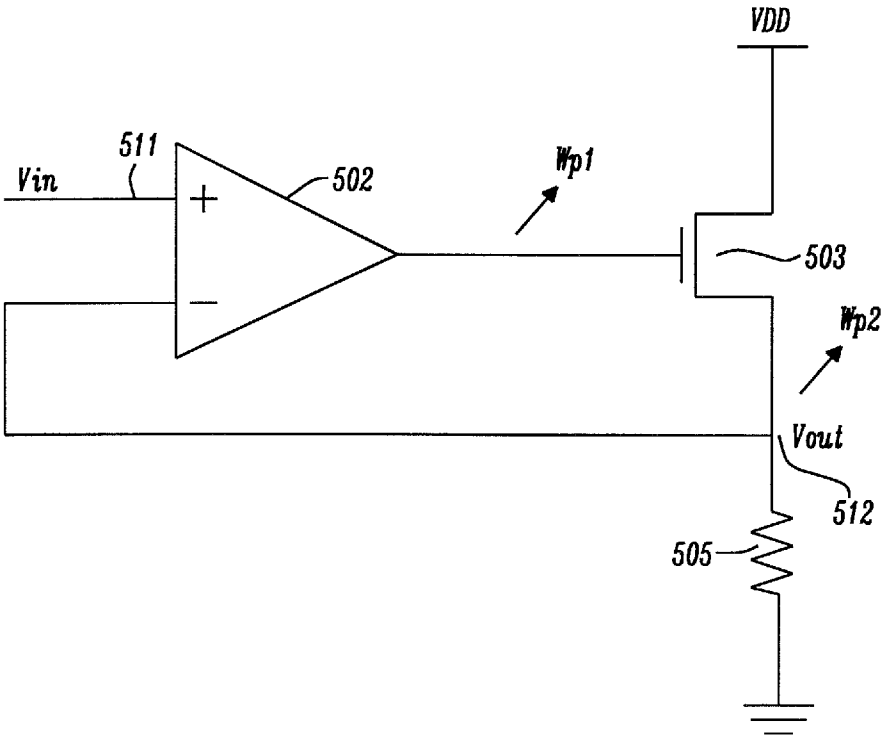
FIG. 5 shows a block diagram of an example linear regulator.

In an example, an LDO comprises an amplifier 502 with a positive feedback loop as gain booster. Vin 511 is an input to amplifier 502. FIG. 5 illustrates a basic LDO structure with an NMOS (N-type metaloxide semiconductor) pass device 503. It should be noted that LDOs with a PMOS pass device may be used as well. The output 512 is fed back to the amplifier 502 using a resistor 505 to form a negative feedback loop.

Figure 6:
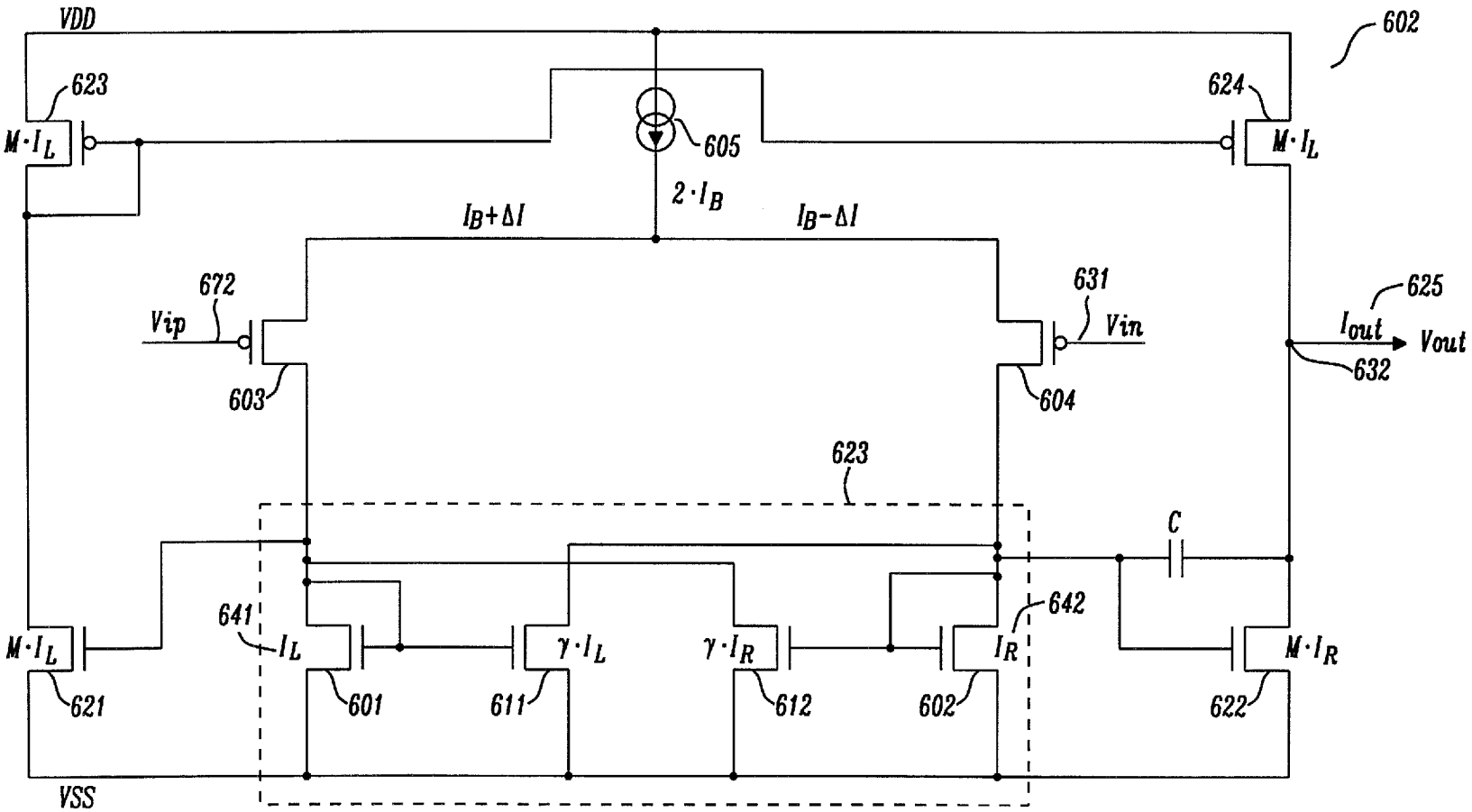
FIG. 6 shows a circuit diagram of an example amplifier with positive feedback.

FIG. 6 shows an example circuit 602 used for the amplifier 502 of FIG. 5. The positive feedback 623 is formed via cross coupled connection. This embodiment is a preferred embodiment in which the positive feedback is embedded within the amplifier structure 502 of FIG. 5. Various types of positive feedbacks may be used.

As outlined above, the use of positive feedback gains of γ≥1 is enabled by an appropriate placement of the poles wp1 and wp2. The poles are associated with the output node of the amplifier 502 of FIG. 5 and with the output node of the pass device 503 of FIG. 5, respectively. As shown in the present document, LDOs with a high open loop gain may be provided by providing a second pole wp2 at high frequencies.

It should be noted that in case of a load current $I_{out}$ 625 with a fixed reference at the positive input in normal operation, the feedback voltage $V_{in}=V_{-}=V_{out}$ 632 on the negative input is usually smaller than the input voltage $V_{in}$ 631 (when using only negative feedback). This difference is setting the output current $I_{out}$ 625 equal to the load current. This is caused by the negative feedback behavior. The negative change in output voltage is causing a larger output (positive) current to counteract. An equivalent circuit would be a voltage source with a resistor in series. In case of a load current the voltage across the load becomes smaller.

FIG. 6 also shows example currents flowing within the amplifier 602 comprising the positive feedback. The negative feedback may be provided by feeding back the output voltage $V_{out}$ 632 to the negative input $V_{in}$ 672 of the differential pair.

The left side (negative side) diode 601 and the right side (positive side) diode 602 are traversed by the currents $I_L$ 641 and $I_R$ 642, respectively. The positive feedback 104 as in FIG. 1 is provided by feeding back the currents through the diodes 601, 602 to the respective other branch of the differential amplifier using current mirrors. For this purpose, the amplifier 602 comprises a left side (negative side) transistor 611 which forms a current mirror with the left side diode 601. The current through the left side transistor 611 is $\gamma \cdot I_L$, wherein $\gamma$ is the positive feedback gain. The current $\gamma \cdot I_L$ is coupled to the right side (positive side) branch of the differential pair. Furthermore, the amplifier 602 comprises a right side (positive side) transistor 612 which forms a current mirror with the right side diode 602. The current through the right side transistor 612 is $\gamma \cdot I_R$, wherein $\gamma$ is the positive feedback gain. The current $\gamma \cdot I_R$ is coupled to the left side (negative side) branch of the differential pair.

From FIG. 6 it can be seen that the output or load current $I_{out}$ 625 is $I_{out}=M \cdot I_R - M \cdot I_L$, wherein M is the gain of the current mirror formed by the right side diode 602 and the right side output transistor 622, and wherein M is the gain of the current mirror formed by the left side diode 601 and the left side output transistors 621, 623, 624. Furthermore, it can be seen that the current $I_B - \Delta I$ through the right side input transistor 604 is $I_B - \Delta I = I_R + \gamma \cdot I_L$; and that the current $I_B + \Delta I$ through the left side input transistor 603 is $I_B + \Delta I = I_L + \gamma \cdot I_R$, wherein $2 \cdot I_B$ is the bias current provided by a current source 605 of the amplifier 602.

The above equations provide: $-2 \cdot \Delta I = I_R - I_L + \gamma \cdot (I_L - I_R)$, and with $$(I_R - I_L) = \frac{I_{cut}}{M},$$

one obtains:

$$-2 \cdot \Delta I = \frac{I_{out}}{M} - \gamma \cdot \frac{I_{out}}{M}, \text{ i.e. } \Delta I = \frac{I_{out}}{2M} \cdot (\gamma - 1).$$

The differential voltage $\Delta V$ at the input of the amplifier 602 is given by the difference between the input voltage $V_{in}$ 631 and the output voltage $V_{out}$ 632, which is fed back to the negative input of the amplifier 602, $\Delta V = V_{in} - V_{out}$. The current difference $\Delta I$ may also be written as $$\Delta I = \frac{AV}{2} \cdot g_m,$$

wherein $g_m$ is the transconductance $g_m$ of the amplifier 602 without the positive feedback. By considering $$\Delta I = \frac{I_{out}}{2M} \cdot (\gamma - 1) \text{ and } \Delta I = -\frac{\Delta V}{2} \cdot g_m,$$

the load current $I_{out}$ 625 becomes $I_{out} = g_{eff} \cdot \Delta V$, wherein $g_{eff}$ is the effective transconductance of the amplifier 602 including the positive feedback with $$g_{eff} = \frac{M}{(1-\gamma)} \cdot g_m.$$

From the above formula, it can be seen that for $\gamma > 1$, the effective transconductance, and by consequence also the output impedance, of the amplifier 602 becomes negative. This leads to the effect that in case of $\gamma > 1$, the output voltage $V_{out}$ 632 increases in case of an increasing load current $I_{out}$ 625.

In other words, if a boosted ($\gamma > 1$) and stable version of the amplifier 602 is used, the above equations indicate that in order to achieve an equilibrium a higher voltage on the negative input is obtained. Again the output current $I_{out}$ 625 is increasing when the output voltage $V_{out}$ 632 drops, which is due to the negative feedback behavior, however, the steady state is reached, when the negative side voltage is higher than the positive reference voltage $V_{in}$ 631 to equalize the load current $I_{out}$ 625. An equivalent circuit to the amplifier 602 would make use of a negative resistor to represent this behaviour with a minimal number of components.

Figure 10:
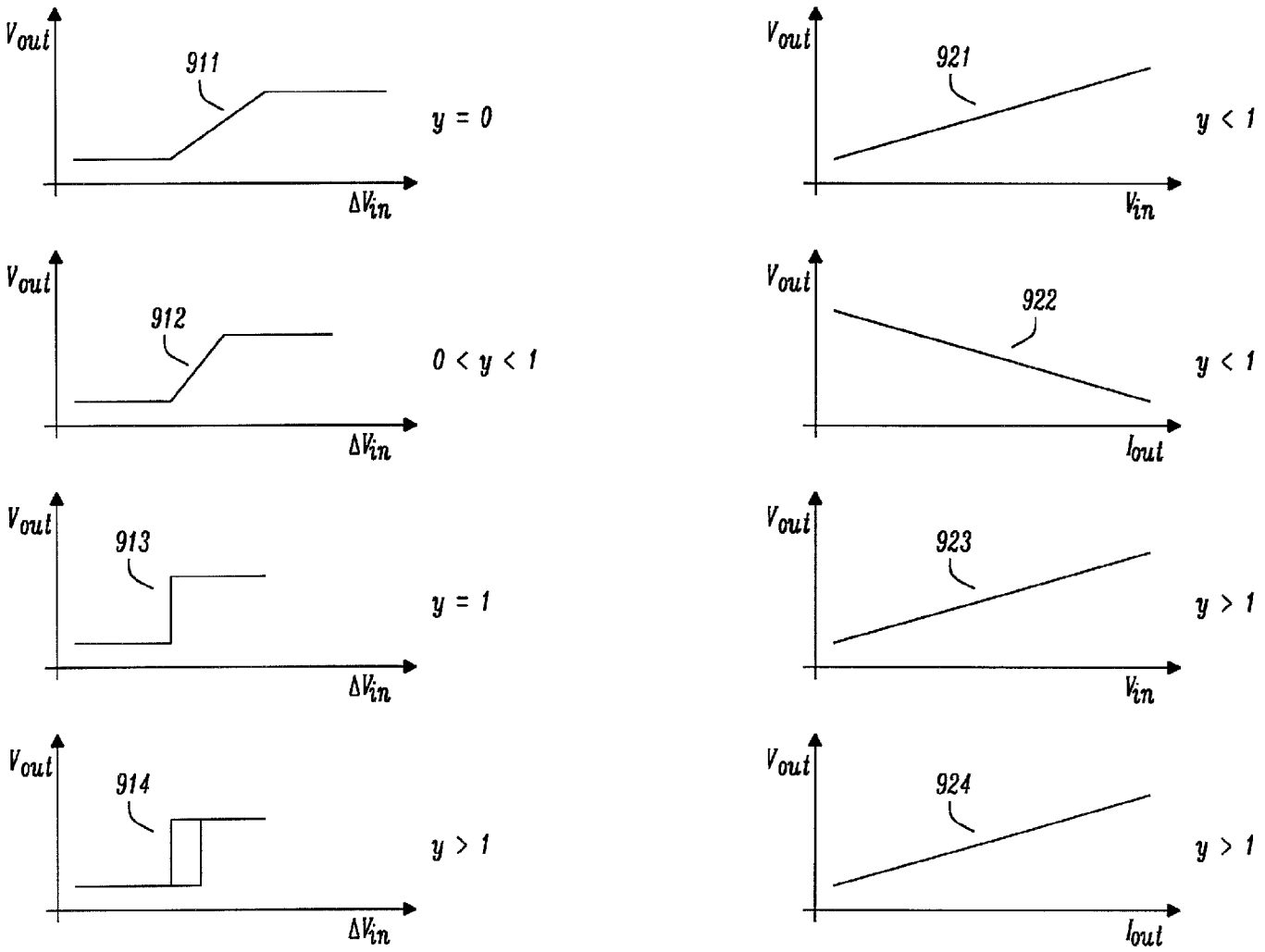
FIG. 10 shows example open loop and closed loop transfer functions of the amplifier of FIG. 6.

The open loop transfer function shows a hysteretic behavior similar to a Schmitt trigger with a typical meta-stable area. However the overall negative feedback is linearizing this into a monotonic transfer function. This is illustrated in FIG. 10 which shows the open loop transfer function of the amplifier 602 for different values of the positive feedback gain $\gamma$. The open loop transfer function is given by the ratio $V_{out}/\Delta V_{in}$ for the case where the negative feedback loop is open. It can be seen that the transfer functions 911, 912, 913 exhibit an increasing gradient from $\gamma=0$ up to $\gamma=1$. At $\gamma=1$ the gain is at infinity. This increasing open loop gain is also shown in FIG. 4. For $\gamma > 1$ the open loop transfer function 914 exhibits a hysteretic behavior.

FIG. 10 also shows the closed loop transfer functions $V_{out}/\Delta v$ for the amplifier 602 having a closed negative feedback loop. It can be seen that for $\gamma < 1$ and for $\gamma > 1$ the closed loop transfer functions 921, 923 exhibit a positive gain. Furthermore, FIG. 10 shows the output impedances $V_{out}/I_{out}$ for $\gamma < 1$ and for $\gamma > 1$. It can be seen that for $\gamma < 1$ the output impedance 922 is negative and for $\gamma > 1$ the output impedance 924 is positive. An amplifier 602 having a negative output impedance 924 may be beneficial for providing regulators 100 as in FIG. 1 with a reduced overall output impedance.

Figure 7:
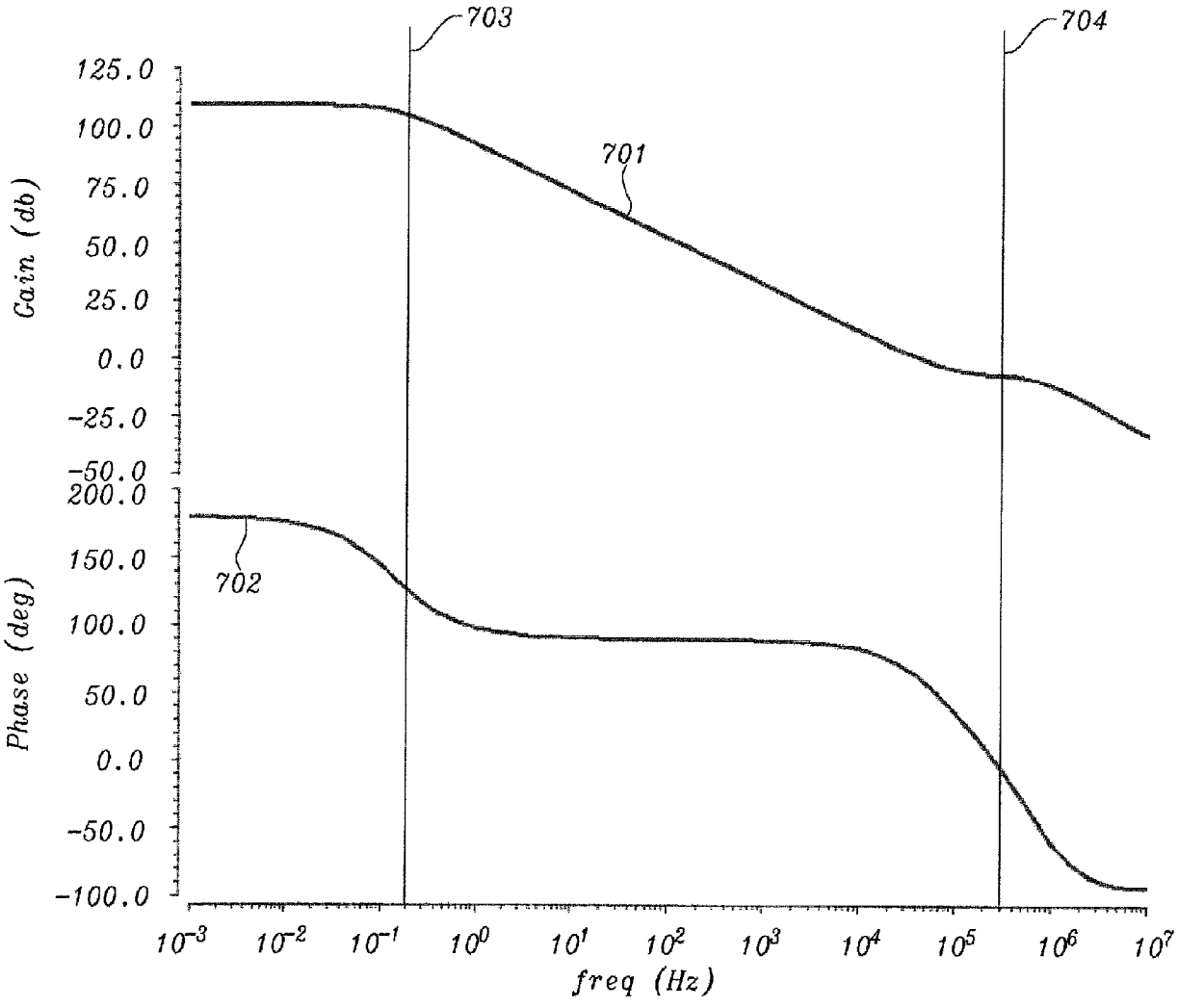
FIGS. 7, 8*a* and 8*b* show example open loop gains for the linear regulator of FIG. 5.

FIG. 7 shows the magnitude of the open loop gain 701 and the phase of the open loop gain 702 for the LDO shown in FIGS. 5 and 6. The magnitude 701 and phase 702 are shown for a positive feedback gain of $\gamma=1$. It can be seen that high (magnitudes of the) open loop gain 701 may be achieved for low frequencies. As a result of this, high PSR may be achieved with the LDO shown in FIGS. 5 and 6.

Figure 8A:
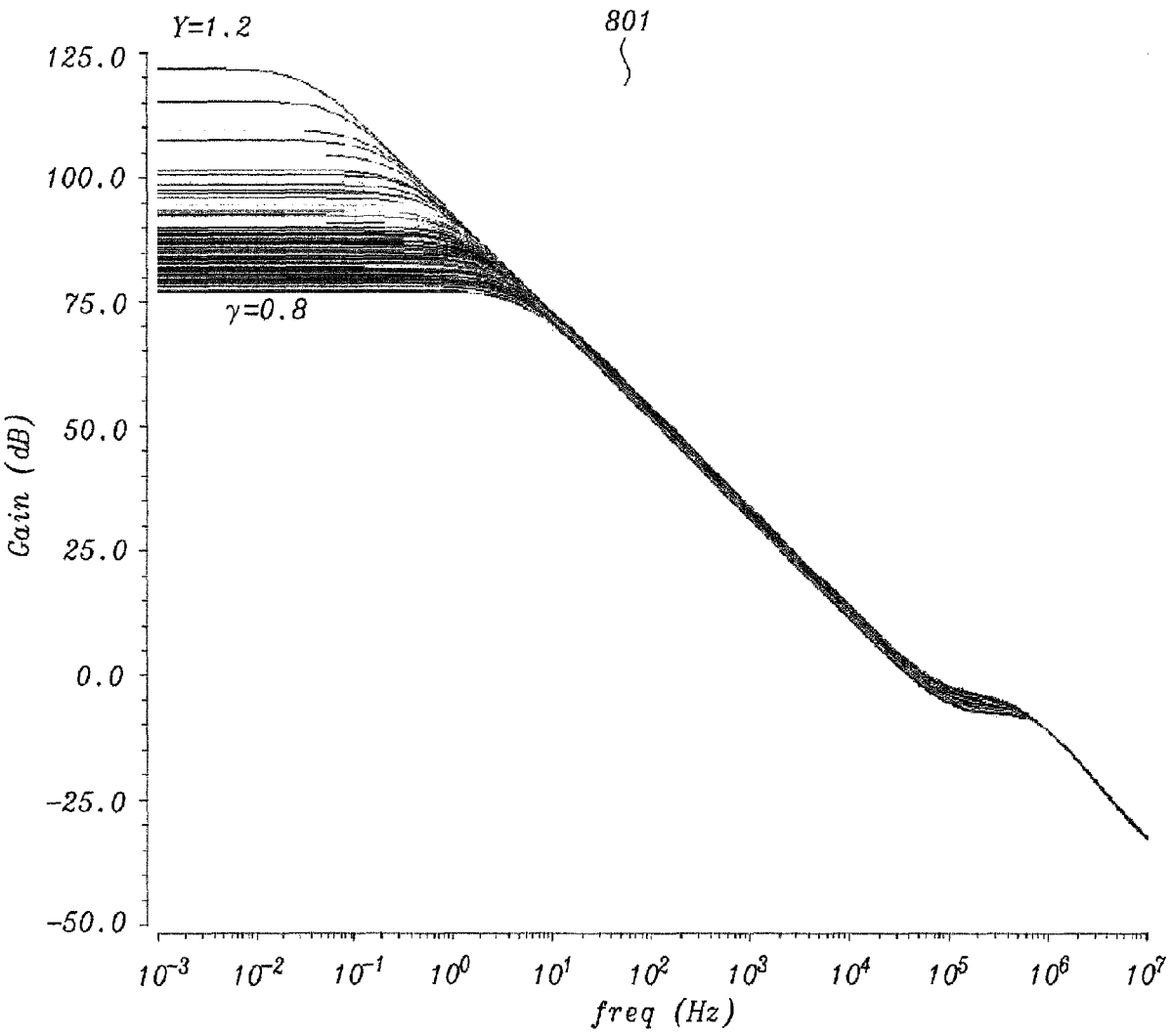
Figure 8B:
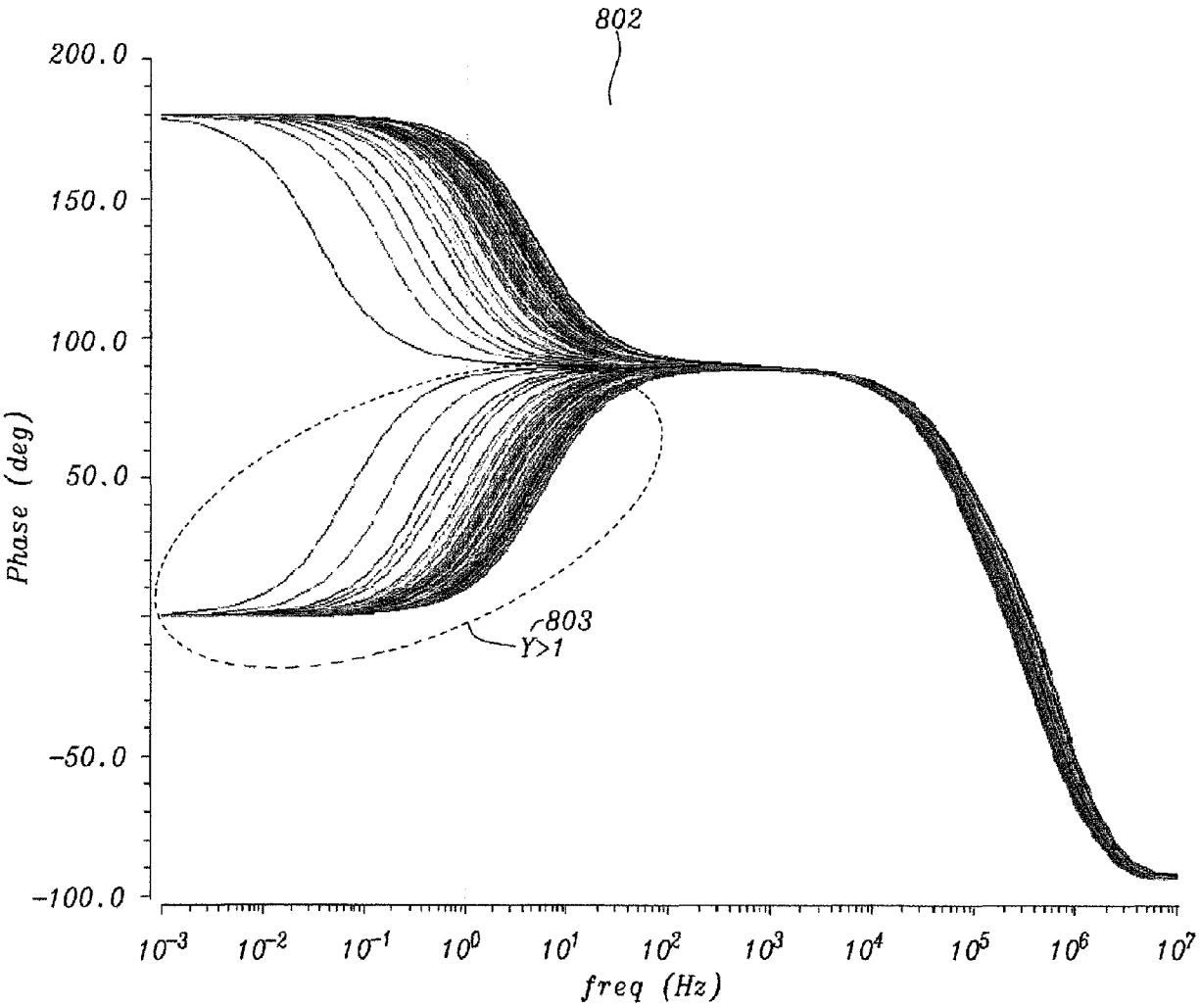

FIG. 8*a* shows the magnitude of the open loop gain 801 and FIG. 8*b* shows the phase of the open loop gain 802 for positive feedback gains ranging from $\gamma=0.8$ to $\gamma=1.2$. From FIG. 8*b*, it can be seen that for $\gamma > 1$ 803, the phase 802 starts at 0 degrees for low frequencies. Hence, selecting higher values of $\gamma$ ensures more stable frequency regions considering the phase inversion point. Consequently, the LDO shown in FIGS. 5 and 6 allows achieving a higher loop gain and providing an increased stable operation region. Transient simulations for $\gamma=1.2$ have shown that even for such extreme values of the positive feedback gain $\gamma$ the LDO operation remains stable.

Figure 9:
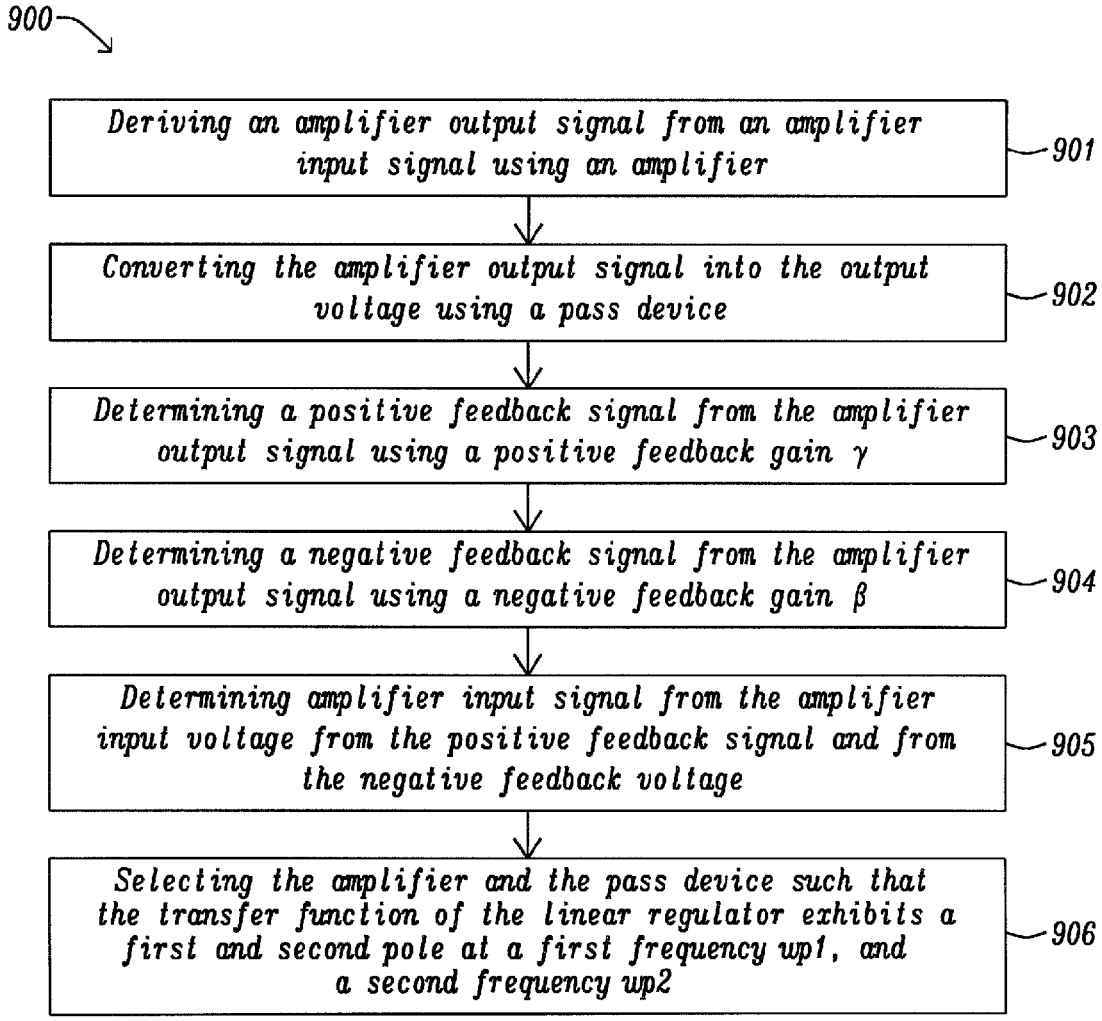
FIG. 9 shows a flow chart of an example method for providing a linear regulator with high open loop gains.

FIG. 9 shows a flow chart of an example method 900 for providing a linear regulator 100 having a high open loop gain. The linear regulator 100 is configured to derive an output voltage 112 from an input voltage 111. The method 900 comprises deriving 901 an amplifier output signal from an amplifier input signal using an amplifier 102 as in FIG. 1, e.g. a differential amplifier. The method 900 further comprises converting 902 the amplifier output signal into the output voltage 112 as in FIG. 1 using a pass device 103 as in FIG. 1. In addition, the method 900 comprises determining 903 a positive feedback signal from the amplifier output signal, using a positive feedback gain γ 104 as in FIG. 1, and determining 904 a negative feedback signal from the output voltage 108, using a negative feedback gain β 105 as in FIG. 1. The amplifier input signal is determined (step 905) from the input voltage 111 as in FIG. 1, from the positive feedback signal and from the negative feedback voltage. In addition, the method 900 comprises selecting 906 the amplifier 102 of FIG. 1 and the pass device 103 of FIG. 1 such that a transfer function of the linear regulator 100 exhibits a first and a second pole at a first frequency wp1 and at a second frequency wp2. Typically, the poles are designed such that the second frequency wp2 is substantially higher than the first frequency wp1 (e.g. by several orders of magnitude).

In the present document, a linear regulator structure has been described which allows achieving a high open loop gain and stable operation.

It should be noted that the description and drawings merely illustrate the principles of the proposed methods and systems. Those skilled in the art will be able to implement various arrangements that, although not explicitly described or shown herein, embody the principles of the invention and are included within its spirit and scope. Furthermore, all examples and embodiment outlined in the present document are principally intended expressly to be only for explanatory purposes to help the reader in understanding the principles of the proposed methods and systems. Furthermore, all statements herein providing principles, aspects, and embodiments of the invention, as well as specific examples thereof, are intended to encompass equivalents thereof.

What is claimed is:

1. A linear regulator configured to derive an output voltage from an input voltage, the linear regulator comprising, an amplifier configured to derive an amplifier output signal from an amplifier input signal;

a pass device configured to convert the amplifier output signal into the output voltage;

a positive feedback loop configured to determine a positive feedback signal from the amplifier output signal, using a positive feedback gain γ;

a negative feedback loop configured to determine a negative feedback signal from the output voltage, using a negative feedback gain β; and a combining unit configured to determine the amplifier input signal from the input voltage, from the positive feedback signal and from the negative feedback voltage; wherein a transfer function of the linear regulator exhibits a first and a second pole at a first frequency wp1 and at a second frequency wp2, respectively, wherein the differential amplifier comprises a differential pair comprising a first input transistor and a second input transistor;

the first and second input transistors are arranged in series with a first and second load diode, respectively;

the positive feedback loop comprises a first mirror transistor forming a current mirror with the first load diode and a second mirror transistor forming a current mirror with the second load diode;

the first mirror transistor is arranged in series with the second input transistor; and the second mirror transistor is arranged in series with the first input transistor.

2. The linear regulator of claim 1, wherein the second frequency wp2 is greater than the first frequency wp1.

3. The linear regulator of claim 1, wherein the second frequency wp2 is greater than the first frequency wp1 by 3, 4, 5 or more orders of magnitude.

4. The linear regulator of claim 1, wherein the first pole is associated with an output node of the amplifier; and the second pole is associated with an output node of the pass device.

5. The linear regulator of claim 1, wherein the amplifier exhibits the first pole at the first frequency wp1; and the pass device exhibits the second pole at the second frequency wp2.

6. The linear regulator of claim 1, wherein the positive feedback gain γ is 0.8 or greater, 0.9 or greater, 1.0 or greater.

7. The linear regulator of claim 1, wherein the amplifier comprises a differential amplifier.

8. The linear regulator of claim 1, wherein the current mirrors provide the positive feedback gain γ.

9. The linear regulator of claim 1, wherein the input voltage is applied to a gate of the second input transistor; and the output voltage is fed back to a gate of the first input transistor to provide the negative feedback loop.

10. The linear regulator of claim 1, wherein the pass device comprises a metal oxide semiconductor transistor.

11. The linear regulator of claim 1, wherein the combining unit is configured to determine the amplifier input signal by adding the positive feedback signal to the input voltage and by subtracting the negative feedback voltage from the input voltage.

12. The linear regulator of claim 1, wherein the positive feedback loop is configured to determine the positive feedback signal by multiplying the amplifier output signal with the positive feedback gain γ.

13. The linear regulator of claim 1, wherein the negative feedback loop is configured to determine the negative feedback signal by multiplying the output voltage with the negative feedback gain β.

14. A method for providing a linear regulator having a high open loop gain, wherein the linear regulator derives an output voltage from an input voltage; the method comprising the steps of:

deriving an amplifier output signal from an amplifier input signal using a differential amplifier;

converting the amplifier output signal into the output voltage using a pass device;

determining a positive feedback signal from the amplifier output signal, using a positive feedback loop with a positive feedback gain γ;

determining a negative feedback signal from the output voltage, using a negative feedback gain β;

determining the amplifier input signal from the input voltage, from the positive feedback signal and from the negative feedback voltage; and selecting the amplifier and the pass device such that a transfer function of the linear regulator exhibits a first and a second pole at a first frequency wp1 and at a second frequency wp2, respectively wherein the differential amplifier comprises a differential pair comprising a first input transistor and a second input transistor;

the first and second input transistors are arranged in series with a first and second load diode, respectively;

the positive feedback loop comprises a first mirror transistor forming a current mirror with the first load diode and a second mirror transistor forming a current mirror with the second load diode;

the first mirror transistor is arranged in series with the second input transistor; and the second mirror transistor is arranged in series with the first input transistor.

15. The method for providing a linear regulator of claim 14, wherein the second frequency wp2 is greater than the first frequency wp1.

16. The method for providing a linear regulator of claim 14, wherein the second frequency wp2 is greater than the first frequency wp1 by 3, 4, 5 or more orders of magnitude.

17. The method for providing a linear regulator of claim 14, wherein the first pole is associated with an output node of the amplifier; and the second pole is associated with an output node of the pass device.

18. The method for providing a linear regulator of claim 14, wherein the amplifier exhibits the first pole at the first frequency wp1; and the pass device exhibits the second pole at the second frequency wp2.

19. The method for providing a linear regulator of claim 14, wherein the positive feedback gain $\gamma$ is 0.8 or greater, 0.9 or greater, 1.0 or greater.

20. The method for providing a linear regulator of claim 14, wherein the current mirrors provide the positive feedback gain $\gamma$.

21. The method for providing a linear regulator of claim 14, wherein the input voltage is applied to a gate of the second input transistor; and the output voltage is fed back to a gate of the first input transistor to provide the negative feedback loop.

22. The method for providing a linear regulator of claim 14, wherein the pass device comprises a metal oxide semiconductor transistor.

23. The method for providing a linear regulator of claim 14, wherein the combining unit determines the amplifier input signal by adding the positive feedback signal to the input voltage and by subtracting the negative feedback voltage from the input voltage.

24. The method for providing a linear regulator of claim 14, wherein the positive feedback loop determine the positive feedback signal by multiplying the amplifier output signal with the positive feedback gain $\gamma$.

25. The method for providing a linear regulator of claim 14, wherein the negative feedback loop determines the negative feedback signal by multiplying the output voltage with the negative feedback gain $\beta$.

* * * * *